US005455618A

United States Patent [19]

Hatori

[11] Patent Number: 5,455,618

[45] Date of Patent: Oct. 3, 1995

[54] OPTICAL SCANNING APPARATUS

[75] Inventor: Masami Hatori, Kanagawa, Japan

[73] Assignee: Fuji Photo Film Co., Ltd., Kanagawa, Japan

[21] Appl. No.: 113,762

[22] Filed: Aug. 31, 1993

[30] Foreign Application Priority Data

Sep. 3, 1992 [JP] Japan ..... 4-235682

[51] Int. Cl.[6] ..... B41J 2/435

[52] U.S. Cl. ..... 347/261

[58] Field of Search ..... 347/255, 260, 347/261; 359/222, 286, 280, 254

[56] References Cited

U.S. PATENT DOCUMENTS 4,281,904 9/1981 Sprague et al. .
4,614,408 9/1986 Mir et al. .
4,623,219 11/1986 Trias .

FOREIGN PATENT DOCUMENTS 2931 1/1990 Japan .

OTHER PUBLICATIONS

English language abstarct for Japanese Patent Publication No. 2–931.

*Primary Examiner*—Mark J. Reinhart

*Attorney, Agent, or Firm*—Sughrue, Mion, Zinn, Macpeak & Seas

[57] ABSTRACT

An optical scanning apparatus comprises an optical waveguide having electro-optic effects, grating-shaped electrodes located on the optical waveguide, a driving circuit for applying a voltage across the electrodes, and a scanning device. A voltage sweep device applies a voltage, which is swept within a predetermined range, across the electrodes within a period, during which an optical wave having been radiated out of the optical waveguide is impinging upon a region outside of an effective scanning region with respect to a recording material. A photodetector detects the optical power of the radiated optical wave impinging upon the region outside of the effective scanning region. A correction device calculates an offset voltage VOFF, which corresponds to the minimum diffraction efficiency of the optical wave guided through the optical waveguide, from an output of the photodetector when the swept voltage is applied across the electrodes. Thereafter, the correction device adds the offset voltage VOFF to a drive voltage, which is applied across the electrodes by the driving circuit, during a period during which the radiated optical wave scans the effective scanning region.

4 Claims, 3 Drawing Sheets

OPTICAL SCANNING APPARATUS

BACKGROUND OF THE INVENTION

1. Field of the Invention

This invention relates to an optical scanning apparatus. This invention particularly relates to an optical scanning apparatus, which is provided with an optical waveguide type of electro-optic device comprising an optical waveguide and grating-shaped electrodes located on the optical waveguide such that an optical wave guided through the optical waveguide may be selectively diffracted in accordance with the condition, under which a voltage is applied across the grating-shaped electrodes, the guided optical wave being thereby modulated or the direction of the optical path of the guided optical wave being thereby changed over.

2. Description of the Prior Art

Optical scanning recording apparatuses have heretofore been used wherein a light beam, which serves as recording light, is modulated in accordance with an image signal, a recording material (such as a photosensitive material) is scanned with the modulated light beam in a main scanning direction and in a sub-scanning direction, and an image represented by the image signal is thereby recorded on the recording material. Also, optical scanning read-out apparatuses have heretofore been used wherein a recording material, on which an image has been recorded, is scanned with a light beam, which serves as reading light, in the main scanning direction and in the sub-scanning direction, light radiated out of the recording material during the scanning (i.e. light reflected by the recording material, light having passed through the recording material, or light emitted by the recording material) is detected, and the image recorded on the recording material is thereby read out.

In the aforesaid types of optical scanning apparatuses, it is often necessary that the light beam can be modulated or that the direction of the optical path of the light beam can be changed over. For such purposes, it has been proposed to utilize an optical waveguide type of electro-optic device as disclosed in, for example, Japanese Unexamined Patent Publication No. 2(1990)-931. The disclosed optical waveguide type of electro-optic device comprises an optical waveguide having electro-optic effects, grating-shaped electrodes (hereinafter referred to as the "EOG electrodes") located on the optical waveguide so as to form an electro-optic grating in the optical waveguide, and a driving circuit for applying a voltage across the EOG electrodes. An guided optical wave, which is guided through the optical waveguide, is thereby selectively diffracted in accordance with the condition, under which the voltage is applied across the EOG electrodes.

In cases where the optical waveguide type of electro-optic device is used, either one of a diffracted optical wave and an undiffracted optical wave (i.e. a zero-order optical wave) can be utilized as the scanning optical wave (i.e. the scanning light beam), and the scanning optical wave can be modulated in accordance with whether it is or is not diffracted or in accordance with the extent of diffraction. Also, an optical switch can be constructed which changes over the direction of the optical path of the guided optical wave in accordance with whether the guided optical wave is or is not diffracted.

Ordinarily, in the aforesaid optical waveguide type of electro-optic device, it is necessary that a buffer layer, which may be constituted of $SiO_2$, or the like, is located between the EOG electrodes and the optical waveguide in order to eliminate scattering and absorption of the guided optical wave by the EOG electrodes.

However, it has been found that, in the optical waveguide type of electro-optic device provided with the buffer layer, the so-called "DC drift phenomenon" easily occurs, i.e. the applied voltage vs. diffraction efficiency characteristics easily fluctuate during the application of the voltage across the EOG electrodes.

If the optical waveguide type of electro-optic device is utilized in an optical scanning apparatus and the DC drift phenomenon occurs in the optical waveguide type of electro-optic device, the optical power of the scanning optical wave will fluctuate. Therefore, the image recording operation or the image read-out operation cannot be carried out accurately.

SUMMARY OF THE INVENTION

The primary object of the present invention is to provide an optical scanning apparatus, wherein the optical power of scanning optical wave is prevented from fluctuating due to the DC drift phenomenon of an optical waveguide type of electro-optic device.

Another object of the present invention is to provide an optical scanning apparatus, with which an image recording operation or an image read-out operation is carried out accurately.

The present invention provides an optical scanning apparatus comprising an optical waveguide, which has electro-optic effects, grating-shaped electrodes, which are located on the optical waveguide, a driving circuit for applying a voltage across the grating-shaped electrodes, and a scanning means for causing an optical wave, which has been radiated out of the optical waveguide, to scan a recording material in a main scanning direction and in a sub-scanning direction, a guided optical wave, which is guided through a portion of the optical waveguide corresponding to the position of the grating-shaped electrodes, being selectively diffracted in accordance with the condition, under which the voltage is applied across the grating-shaped electrodes, wherein the improvement comprises the provision of:

i) a voltage sweep means for applying a voltage, which is swept within a predetermined range, across the grating-shaped electrodes within a period, during which the optical wave having been radiated out of the optical waveguide is impinging upon a region outside of an effective scanning region with respect to the recording material, ii) a photodetector for detecting the optical power of the optical wave having been radiated out of the optical waveguide, which optical wave is impinging upon the region outside of the effective scanning region, and iii) a correction means for calculating an offset voltage VOFF, which corresponds to the minimum diffraction efficiency of the guided optical wave, from an output of the photodetector when the swept voltage is applied across the grating-shaped electrodes, the correction means thereafter adding the offset voltage VOFF to a drive voltage, which is applied across the grating-shaped electrodes by the driving circuit, during a period during which the optical wave having been radiated out of the optical waveguide scans the effective scanning region.

If no DC drift phenomenon occurs with the optical waveguide type of electro-optic device, the relationship between a drive voltage V, which is applied across the EOG electrodes, and a diffraction efficiency $\eta$ will be expressed as $$\eta=\sin^2 (A.N_{eff} LV/\lambda)$$

wherein A represents a fixed number, Neff represents the effective refractive index of the optical waveguide, L represents the EOG electrode length, and $\lambda$ represents the optical wavelength. In FIG. 5, curve "a" indicates the aforesaid relationship.

Therefore, when the applied voltage V is equal to zero, the diffraction efficiency $\eta$ is also equal to zero. On this assumption, control of the drive voltage for modulation of the optical wave or change-over of the direction of the optical path of the optical wave is carried out. Specifically, for example, in cases where the diffracted optical wave is utilized as the scanning optical wave and is subjected to on-off modulation, the applied voltage V is ordinarily set at zero in order to set the optical power of the scanning optical wave at zero, and the applied voltage V is set at $V\pi$ in order to set the optical power of the scanning optical wave at the maximum value, at which the maximum diffraction efficiency $\eta$max is obtained.

However, as illustrated in FIG. 5, if the DC drift phenomenon occurs, the applied voltage vs. diffraction efficiency characteristics will shift along the horizontal axis direction and will change to the characteristics indicated by curve "b." In such cases, even if the applied voltage V is set at zero, the diffraction efficiency $\eta$ will not become zero and will take the value of $\eta 1$. Also, when the applied voltage V is set at $V\pi$, the diffraction efficiency $\eta$ will take the value of $\eta 2$, which is not much different from the value of $\eta 1$. Therefore, the desired on-off modulation cannot be carried out.

Accordingly, with the optical scanning apparatus in accordance with the present invention, within a period during which the optical wave having been radiated out of the optical waveguide is impinging upon a region outside of the effective scanning region with respect to the recording material, the offset voltage VOFF, at which the diffraction efficiency $\eta$ becomes minimum, is calculated. During the effective scanning period, the offset voltage VOFF is added to the levels of the applied voltage, which are to be set originally, i.e. to each of 0 (zero) and $V\pi$. As a result, the same effects can be obtained as when the applied voltage V is set at 0 (zero) and $V\pi$ in accordance with the characteristics indicated by curve "a" in FIG. 5.

The on-off modulation of the scanning optical wave is carried out in the manner described above. The adverse effects of the DC drift phenomenon can be eliminated in the same manner as that described above also when the scanning optical wave is continuously modulated in accordance with the diffraction efficiency under the characteristics indicated by curve "a" in FIG. 5, or when the direction of the optical path of the guided optical wave is changed over in accordance with whether the guided optical wave is or is not diffracted.

As described above, with the optical scanning apparatus in accordance with the present invention, within the period, during which the optical wave having been radiated out of the optical waveguide is impinging upon the region outside of the effective scanning region with respect to the recording material, the voltage sweep means applies the voltage, which is swept within a predetermined range, across the EOG electrodes. The photodetector detects the optical power of the optical wave having been radiated out of the optical waveguide, which optical wave is impinging upon the region outside of the effective scanning region. When the swept voltage is applied across the EOG electrodes, the correction means calculates the offset voltage VOFF, which corresponds to the minimum diffraction efficiency of the guided optical wave, from the output of the photodetector. Thereafter, during the period during which the optical wave having been radiated out of the optical waveguide scans the effective scanning region, the correction means adds the offset voltage VOFF to the drive voltage, which is applied across the EOG electrodes by the driving circuit. Therefore, the adverse effects of the DC drift phenomenon occurring in the optical waveguide type of electro-optic device can be eliminated, and the image recording operation or the image read-out operation can be carried out accurately.

DESCRIPTION OF THE PREFERRED EMBODIMENTS

The present invention will hereinbelow be described in further detail with reference to the accompanying drawings.

Figure 1:
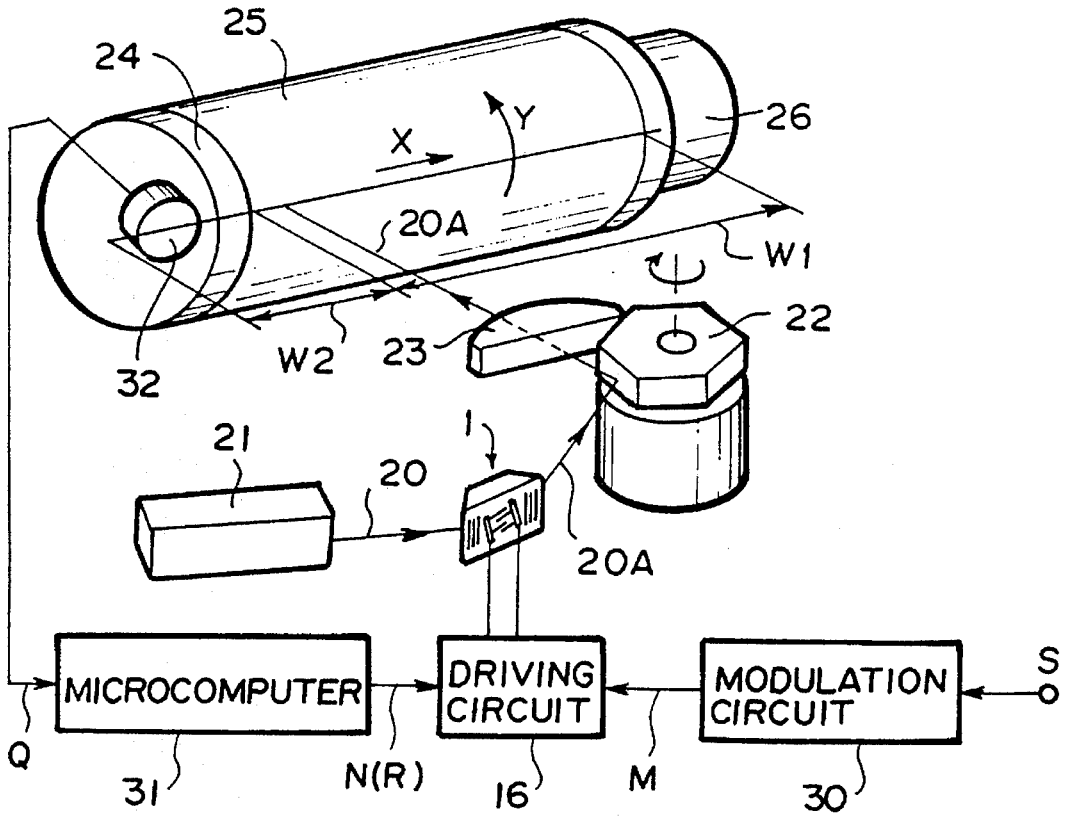
FIG. 1 is a schematic perspective view showing an embodiment of the optical scanning apparatus in accordance with the present invention.
Figure 2:
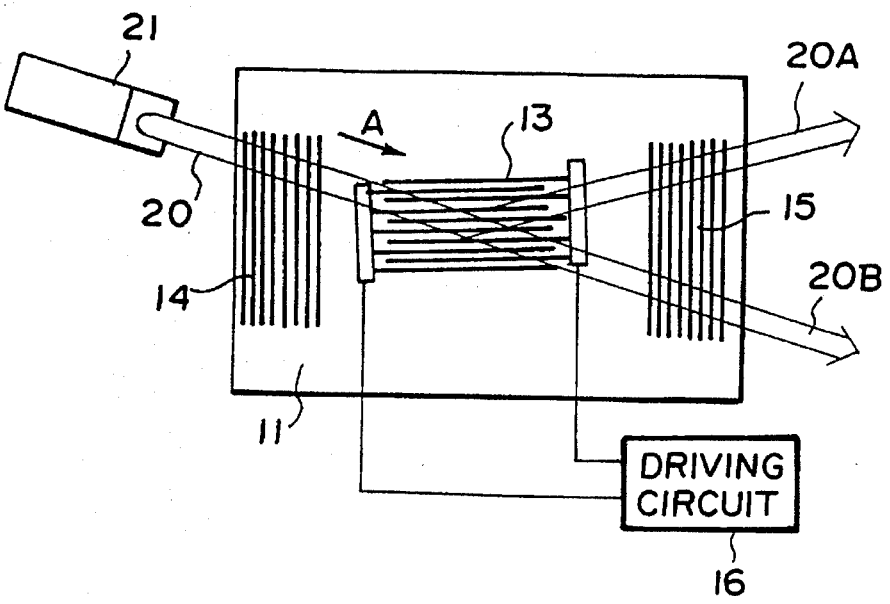
FIG. 2 is a plan view showing an optical waveguide type of electro-optic device employed in the embodiment of FIG. 1.
Figure 3:
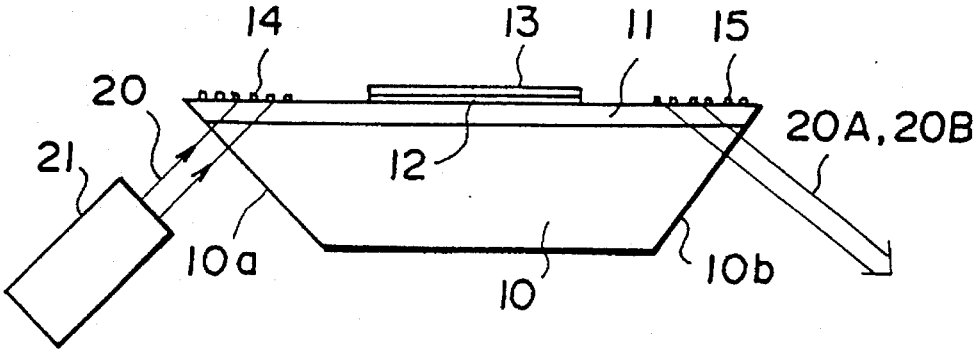
FIG. 3 is a side view showing the optical waveguide type of electro-optic device.

FIG. 1 is a schematic perspective view showing an embodiment of the optical scanning apparatus in accordance with the present invention. FIG. 2 is a plan view showing an optical waveguide type of electro-optic device 1 employed in the embodiment of FIG. 1. FIG. 3 is a side view showing the optical waveguide type of electro-optic device 1.

As illustrated in FIG. 1, a laser beam source 21, which may be constituted of an He-Ne laser, or the like, produces a laser beam (i.e. an optical wave) 20. The optical wave 20 impinges upon the optical waveguide type of electro-optic device 1 and is subjected to on-off modulation in accordance with an image signal S as will be described later. A modulated optical wave 20A is thereby obtained from the optical waveguide type of electro-optic device 1. The modulated optical wave 20A impinges upon a rotating polygon mirror 22, which serves as a main scanning means. The modulated optical wave 20A is reflected and deflected by the rotating polygon mirror 22, and then passes through a scanning lens 23, which may be constituted of an f$\theta$ lens, or the like. The modulated optical wave 20A is thus converged on a photosensitive material 25, which is supported on a cylindrical platen 24. In this manner, the modulated optical wave 20A scans the photosensitive material 25 in the main direction indicated by the arrow X. At the same time, the cylindrical platen 24 is rotated by a motor 26, which constitutes a sub-scanning means, in the sub-scanning direction, which is indicated by the arrow Y. In this manner, the photosensitive material 25 is two-dimensionally scanned with the modulated optical wave 20A, and a binary image represented by the image signal S is recorded on the photosensitive material 25.

How the optical wave 20A is modulated by the optical waveguide type of electro-optic device 1 will be described hereinbelow with reference to FIGS. 2 and 3. The optical waveguide type of electro-optic device 1 comprises an LiNbO3 substrate 10, and a thin-film optical waveguide 11 located on the $LiNbO_3$ substrate 10. The optical waveguide type of electro-optic device 1 also comprises a buffer layer 12, which is constituted of an $SiO_2$ film and which is overlaid on the optical waveguide 11, and EOG electrodes 13, which are located on the buffer layer 12. The optical waveguide type of electro-optic device 1 further comprises a linear grating coupler (hereinafter referred to as the "LGC") 14 for entry of the optical wave and an LGC 15 for radiation of the optical wave. The LGC 14 and the LGC 15 are located on the surface of the optical waveguide 11. The LGC 14 and the LGC 15 are spaced apart from each other with the EOG electrodes 13 intervening therebetween. The optical waveguide type of electro-optic device 1 is connected to a driving circuit 16, which applies a predetermined level of voltage across the EOG electrodes 13.

The laser beam source 21 is located such that the optical wave 20 in the form of a collimated beam may pass through an obliquely cut end face 10*a* of the substrate 10. The optical wave 20 then passes through the optical waveguide 11 and impinges upon the LGC 14. Thereafter, the optical wave 20 is diffracted by the LGC 14, enters into the optical waveguide 11, and travels through the optical waveguide 11 in the guided mode along the direction indicated by the arrow A.

The optical wave 20 (which is now the guided optical wave) is guided through the portion of the optical waveguide 11 corresponding to the position of the EOG electrodes 13. When no voltage is applied across the EOG electrodes 13, the guided optical wave 20 travels straight ahead as an undiffracted optical wave 20B. When a predetermined level of voltage is applied by the driving circuit 16 across the EOG electrodes 13, the refractive index of the optical waveguide 11 having the electro-optic effects changes, and a grating is thereby formed in the optical waveguide 11. The guided optical wave 20 is diffracted as the diffracted optical wave 20A by the grating. The diffracted optical wave 20A or the undiffracted optical wave 20B is diffracted at the position of the LGC 15 towards the substrate 10. Thereafter, the optical wave 20A or the optical wave 20B is radiated out of the optical waveguide type of electro-optic device 1 from an obliquely cut end face 10b of the substrate 10.

Figure 5:
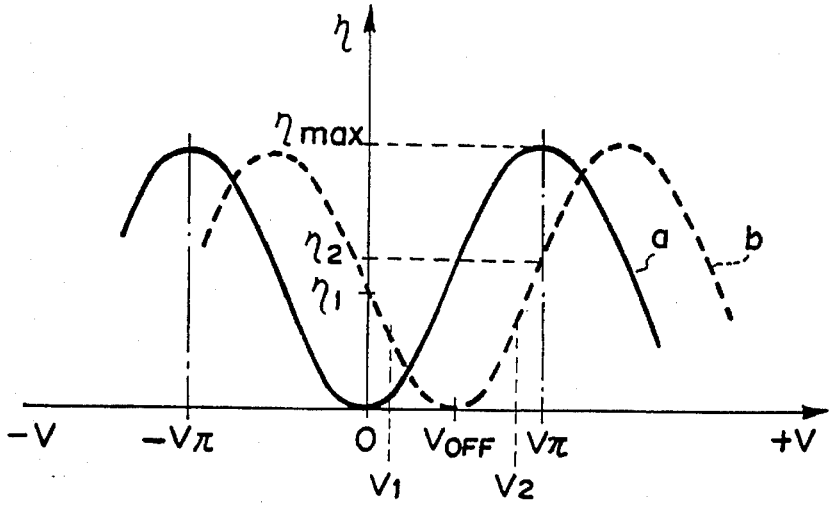
FIG. 5 is an explanatory graph showing a DC drift phenomenon.

Therefore, in cases where the optical wave 20A, which has been radiated out of the optical waveguide type of electro-optic device 1, is utilized as the scanning optical wave, the optical wave 20A can be modulated in accordance with whether the voltage is or is not applied from the driving circuit 16 across the EOG electrodes 13. In this embodiment, a modulation circuit 30 shown in FIG. 1 receives the image signal S and generates a modulation signal M, which selectively sets the applied voltage V at zero or at $V\pi$ that yields the maximum diffraction efficiency $\eta max$ as shown in FIG. 5, in accordance with the image signal S. The modulation signal M is fed into the driving circuit 16, and the on-off modulation of the optical wave 20A is thereby carried out in accordance with the image signal S.

How the adverse effects of the DC drift phenomenon occurring in the optical waveguide type of electro-optic device 1 are eliminated will be described hereinbelow. In FIG. 1, W1 represents the effective scanning region with respect to the photosensitive material 25, which serves as the recording material. In this embodiment, the region, over which the scanning with the rotating polygon mirror 22 is carried out, is wider than the effective scanning region W1 so as to include a scanning region (i.e., a free region) W2 on the side outward from the effective scanning region W1. Also, a photodetector 32, such as a photomultiplier, which has a comparatively wide light receiving face is located on the side outward from one end of the cylindrical platen 24, such that the photodetector 32 can continuously detect the optical power of the optical wave 20A at a portion of the free region W2.

The driving circuit 16 and a microcomputer 31 together constitute a voltage sweep means. The microcomputer 31 feeds a signal N, which sweeps the voltage V applied across the EOG electrodes 13 between predetermined voltages V1 and V2, into the driving circuit 16. The timing, with which the signal N is fed into the driving circuit 16, is set such that the voltage sweep may be carried out within a period, during which the optical wave 20A is received by the photodetector 32. Also, it is assumed that the applied voltage vs. diffraction efficiency $\eta$ characteristics will at most change from the original characteristics, which are indicated by curve "a" in FIG. 5, to the characteristics indicated by curve "b" in FIG. 5. In such cases, the range of voltage from V1 to V2 is selected such that it may contain the offset voltage VOFF, at which the diffraction efficiency $\eta$ becomes equal to zero. Such values of the voltages V1 and V2 can be determined through experiments or experience.

Figure 4:
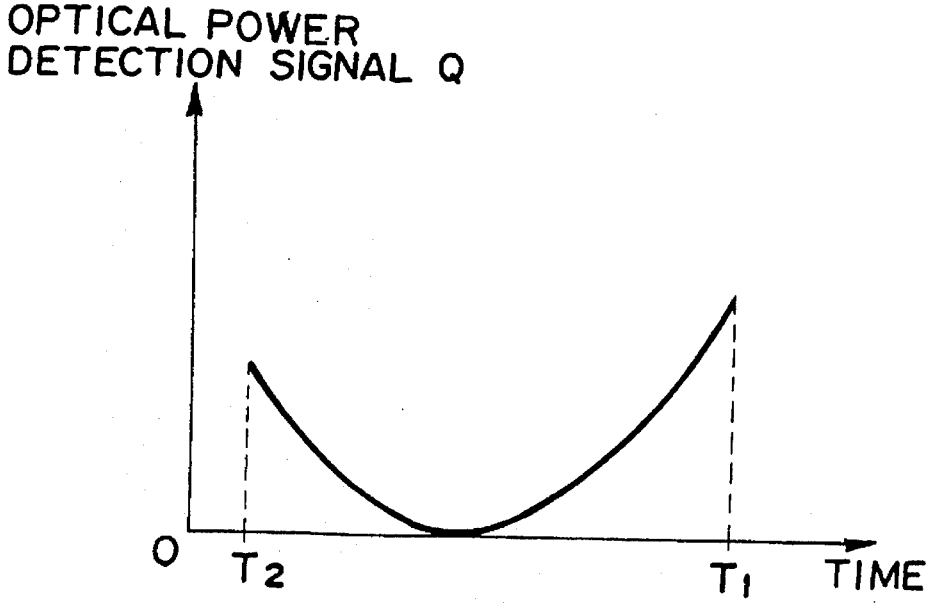
FIG. 4 is a graph showing an output of a photodetector employed in the embodiment of FIG. 1.

When the applied voltage V is swept in the manner described above, the diffraction efficiency $\eta$ changes in accordance with the level of the applied voltage V. Therefore, an output signal Q obtained from the photodetector 32 changes in the pattern shown in FIG. 4. In FIG. 4, the time T1 represents the time, at which the level of the applied voltage V is set at V1, and the time T2 represents the time, at which the level of the applied voltage V is set at V2. The optical wave detection signal Q generated by the photodetector 32 is fed into the microcomputer 31, which also serves as a correction means.

The microcomputer 31 calculates the value of the applied voltage V at the instant at which the optical wave detection signal Q takes the minimum value, i.e. at the instant at which the diffraction efficiency $\eta$ becomes zero. The calculated value of the applied voltage V represents the value of the offset voltage VOFF shown in FIG. 5. Thereafter, the microcomputer 31 feeds a correction signal R, which uniformly raises the level of the applied voltage V by the value of the offset voltage VOFF, into the driving circuit 16 during the period, during which the optical wave 20A scans the effective scanning region W1.

Figure 6A:
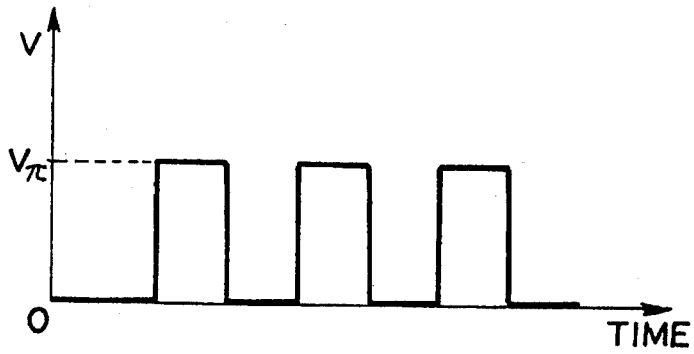
FIGS. 6A and 6B are graphs showing wave forms of voltage applied across EOG electrodes in the embodiment of FIG. 1.
Figure 6B:
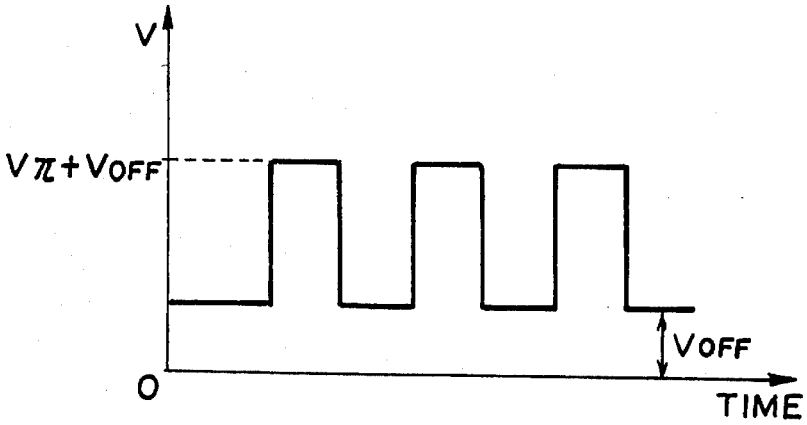

Specifically, in cases where the level of the applied voltage V, which is set in accordance with the modulation signal M, is as shown in FIG. 6A, the correction signal R works such that the voltage having the level shown in FIG. 6B may be actually applied across the EOG electrodes 13. When the correction is carried out in this manner, the adverse effects of the DC drift phenomenon can be eliminated, and the optical power of the optical wave 20A accurately takes the value of zero or the maximum value corresponding to the maximum diffraction efficiency $\eta max$. The reasons for this have been described above in detail.

In the embodiment described above, the correction for eliminating the adverse effects of the DC drift phenomenon is carried out each time the optical wave 20A scans along one main scanning line. The zero-point shift due to the DC drift phenomenon occurs slowly over a comparatively long length of time (e.g. several seconds to several minutes). Therefore, a single operation for the aforesaid correction may be carried out each time the optical wave 20A scans along several main scanning lines. As another alternative, instead of the free region of the main scanning operation being utilized, a free region of the sub-scanning operation may be utilized to carry out the aforesaid correction, and a single operation for the correction may be carried out each time a single image is recorded.

In the aforesaid embodiment, the optical scanning apparatus in accordance with the present invention is utilized in order to record an image on the recording material. The optical scanning apparatus in accordance with the present invention is also applicable when an image having been recorded on a recording material is read out through the scanning with the optical wave, or when the direction of the optical path of the optical wave is changed over by the optical waveguide type of electro-optic device.

What is claimed is:

1. An optical scanning apparatus comprising an optical waveguide, which has electro-optic effects, grating-shaped electrodes, which are located on the optical waveguide, a driving circuit for applying a voltage across the grating-shaped electrodes, and a scanning means for causing an optical wave, which has been radiated out of the optical waveguide, to scan a recording material in a main scanning direction and in a sub-scanning direction, a guided optical wave, which is guided through a portion of the optical waveguide corresponding to the position of the grating-shaped electrodes, being selectively diffracted in accordance with the condition, under which the voltage is applied across the grating-shaped electrodes, wherein the improvement comprises the provision of:

i) a voltage sweep means for applying a voltage, which is swept within a predetermined range, across the grating-shaped electrodes within a period, during which the optical wave having been radiated out of the optical waveguide is impinging upon a region outside of an effective scanning region with respect to the recording material, ii) a photodetector for detecting the optical power of the optical wave having been radiated out of the optical waveguide, which optical wave is impinging upon the region outside of the effective scanning region, and iii) a correction means for calculating an offset voltage VOFF, which corresponds to the minimum diffraction efficiency of the guided optical wave, from an output of the photodetector when the swept voltage is applied across the grating-shaped electrodes, the correction means thereafter adding the offset voltage VOFF to a drive voltage, which is applied across the grating-shaped electrodes by the driving circuit, during a period during which the optical wave having been radiated out of the optical waveguide scans the effective scanning region.

2. An apparatus as defined in claim 1 wherein the optical wave, which has been radiated out of the optical waveguide, is modulated in accordance with an image signal, and an image represented by the image signal is recorded on the recording material.

3. An apparatus as defined in claim 1 wherein an image has been recorded on the recording material and is read out from the recording material through the scanning with the optical wave, which has been radiated out of the optical waveguide.

4. An apparatus as defined in claim 1 wherein the optical wave is a laser beam.

* * * * *